US005934606A

United States Patent [19]

Guild

[11] Patent Number: 5,934,606

[45] Date of Patent: Aug. 10, 1999

[54] KNOCK-DOWN, REUSABLE MODULAR TRANSMISSION CABLE REEL AND METHOD OF MAKING SAME

[75] Inventor: Joseph R. Guild, Dallas, Tex.

[73] Assignee: Allen Telecom Inc., Solon, Ohio

[21] Appl. No.: 08/994,283

[22] Filed: Dec. 19, 1997

[51] Int. Cl.[6] ..... B65H 75/00; B65H 75/14

[52] U.S. Cl. ..... 242/608.4; 242/603; 242/609.2; 242/610.5

[58] Field of Search ..... 242/603, 608.4, 242/609.1, 609.2, 610.5, 118.41, 407.1, 118.62

[56] References Cited

U.S. PATENT DOCUMENTS

| | | | |
|---|---|---|---|
| 1,915,825 | 6/1933 | Hescock | 242/608.4 |
| 3,985,359 | 10/1976 | Moore | 242/603 |

FOREIGN PATENT DOCUMENTS

| | | | |
|---|---|---|---|
| 2252757 | 6/1975 | France | 242/608.4 |

*Primary Examiner*—John Q. Nguyen
*Attorney, Agent, or Firm*—Laff, Whitesel & Saret, Ltd.

[57] ABSTRACT

A knock-down, reusable modular transmission line cable reel assembly having at least two side-by-side compartments for coiling transmission line, and including a pair of spaced apart, generally circular parallel end flanges, at least one intermediate, generally circular partition ring, a cable support core positioned between each end flange and adjacent partition ring and between each pair of adjacent partition rings, a plurality of tie rods extending between the pair of end flanges, extending through the cable support cores, and extending through the partition rings, and releasable fasteners secured to the tie rods for biasing the end flanges, partition rings and support cores towards each other in an assembled array, and so that when the fasteners are released, the end flanges, partition rings, support cores and tie rods are easily separated for transport in a knocked-down form for reassembly and reuse.

18 Claims, 2 Drawing Sheets

KNOCK-DOWN, REUSABLE MODULAR TRANSMISSION CABLE REEL AND METHOD OF MAKING SAME

BACKGROUND OF THE INVENTION

When radio frequency communication sites in which antennas for RF transmissions are to be installed are erected and constructed, frequently separate lengths of transmission line cables such as coaxial cables of diverse sizes are required. Sometimes as many as six different diameters and cables are required. To provide the necessary cabling, the practice has been to obtain a wooden reel of each individual cable size to be used at the site. Thus, this has required shipment to the site of as many as six reels, at substantial expense.

After the individual wooden reels arrive at the site, installers are required to spend the time necessary to seat the individual reels, one at a time, on jack stands, and then to prepare the top ends of the cables for connector installation. Upon completion of the connector installation, the installers then secure the hoisting grip and hoist the cable to the appropriate location on the support structure and complete the installation procedure. Once the cable is extracted from the wooden reel, the installers lower the jack stands, extract the empty reel, and place the next reel on the jack stands.

This installation procedure is repeated until all necessary reels of transmission line or cable are completely installed which may often be as many as six times. Obviously, this is time-consuming and expensive. The cost of transportation of plural reels is an additional cost which must be paid for by the customer or vendor and, typically, the reels are then thrown away because the cost of returning them to the supplier for reuse is too high.

One attempt to alleviate some of the expense has been to provide a wooden reel of a generally conventional type with wooden partitions nailed in place in parallel to the reel end flanges. In this manner, a reel having multiple compartments adapted for receiving multiple cables may be provided. However, such reels are not desirable for a number of reasons including the fact that they are not reusable because the cost of shipping large, empty reels of that type is too high.

It would be of advantage to provide a cable reel for easily shipping multiple cable types, which is modular and which is reusable and shippable at a reasonable cost.

SUMMARY OF THE INVENTION

In accordance with the present invention, a knockdown, reusable transmission line cable reel assembly defining at least two side-by-side compartments for coiling transmission line is provided. The reel assembly comprises a pair of spaced apart, generally circular parallel end flanges, at least one intermediate, generally circular partition ring, each partition ring being oriented generally parallel to the end flanges and being spaced therefrom and from each other, a cable support core positioned between each end flange and adjacent partition ring and between each pair of adjacent partition rings when more than one partition ring is present, a plurality of tie rods extending between the pair of end flanges, the tie rods extending through the cable support cores and extending through the partition rings, and releasable fastening means secured to the tie rods for biasing the end flanges towards each other. The releasable fastening means secure the end flanges, partition rings, support cores and tie rods in an assembled array, and permit the end flanges, partition rings, support cores and tie rods to be easily separated for transport in a knocked-down form for reassembly and reuse.

Desirably the reel assembly cable support cores comprise elongated core strips which may be rolled into cylindrical configurations. The core strips have complementary end portions which are secured together by removable fasteners. The cable support cores comprise strips having side edges and a central core portion. The end flanges define inwardly extending projections and the partition rings define outwardly extending projections, the inwardly and outwardly extending projections being positioned to support an adjacent cable support core by its side edges.

In a preferred form, the cable reel assembly tie rods define threaded ends which extend through the end flanges, and the releasable fastening means are threaded fasteners on the threaded ends.

In one form, the end flanges each comprise a circular outer ring, a central hub and a plurality of spokes secured to the outer ring and to the central hub and the spokes mount inwardly projecting guide posts for the tie rods and for supporting an adjacent cable support core. The partition rings may each comprise a circular outer ring, a plurality of spokes and a support plate, the partition spokes being secured to the outer ring and the support plate, and the support plate projects outwardly beyond the partition spokes for supporting an adjacent cable support core.

In a most preferred form, the cable reel assembly uses at least three tie rods and defines from three to six side-by-side compartments and comprises, respectively, from two to five partition rings and from three to six cable support cores, respectively.

A method of constructing a knock-down, reusable transmission line cable reel assembly in accordance with the present invention desirably comprises the steps of providing a first, generally circular end flange, removably securing a plurality of tie rods to the first end flange, providing and positioning a first cable support core around the tie rods and against the first end flange, providing an intermediate partition ring having a support means projecting outwardly from each side thereof, juxtaposing the intermediate partition ring with the support means lying around the tie rods and within the first cable support core, positioning a further cable support core around the tie rods, around the support means and against an intermediate partition ring, positioning a second end flange against the further cable support core, and removably securing the tie rods to the second end flange and biasing the end flanges towards each other to releasably secure the end flanges, partition rings, support cores and tie rods against each other thereby to provide a cable reel assembly having at least two side-by-side cable compartments, and wherein the end flanges, partition rings, support cores and tie rods may be readily separated for transport in a knocked-down form for reassembly and reuse.

Further objects, features and advantages of the present invention will become apparent from the following description and drawings.

DETAILED DESCRIPTION OF THE INVENTION

Figure 1:
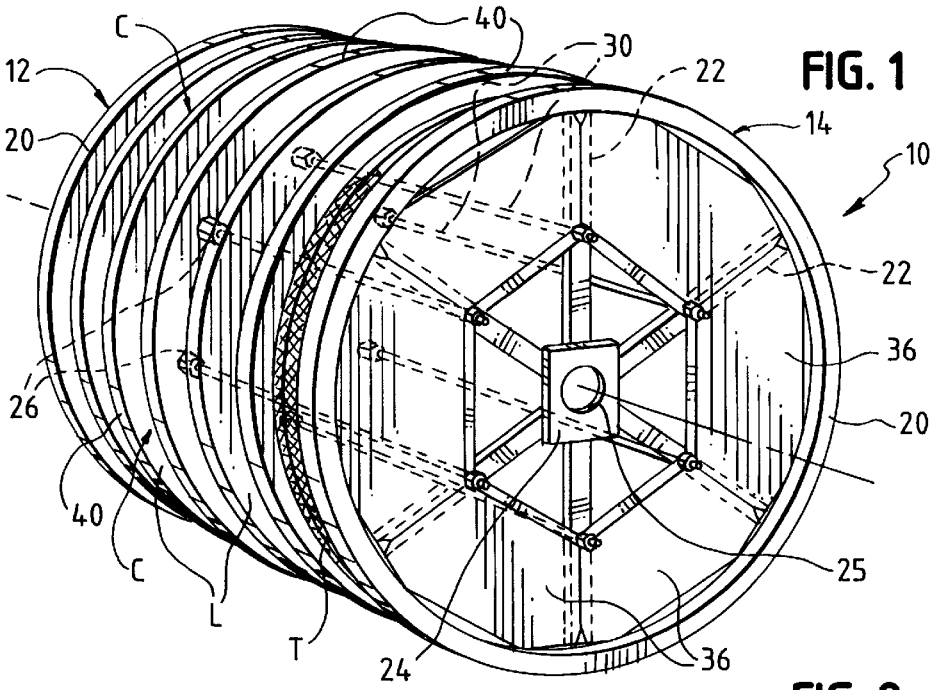
FIG. 1 is a perspective view of a knock-down, reusable modular cable reel made in accordance with the present invention.
Figure 2:
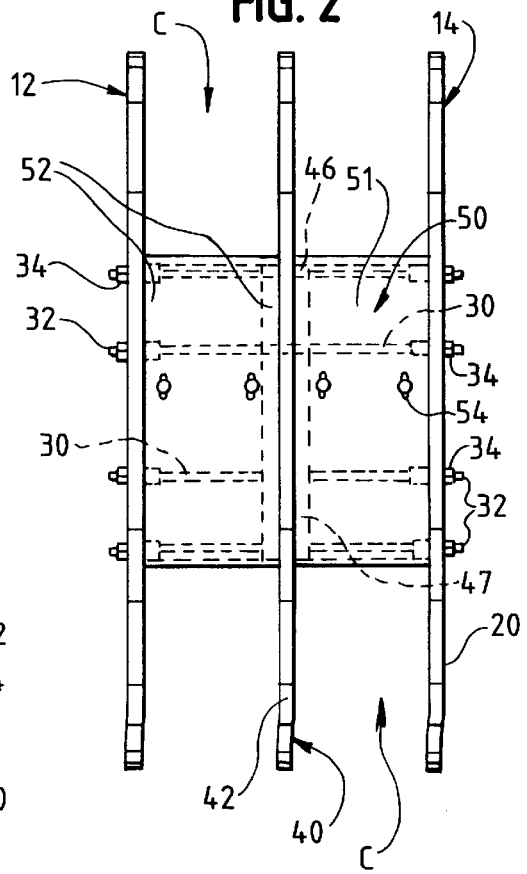
FIG. 2 is a front elevational fragmentary view of a cable reel of FIG. 1.
Figure 3:
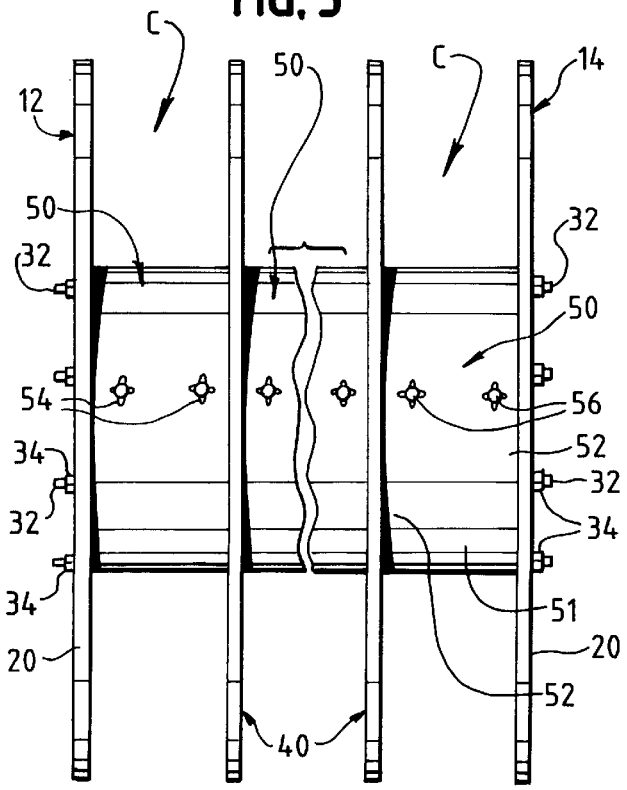
FIG. 3 is a front elevational view of a two-compartment cable reel of the present invention.

Referring now to the drawings, a knock-down modular and reusable cable reel assembly in accordance with the present invention defines an array of compartments C in which cables may be reeled and from which cable may be payed out. Cable reel 10 includes a first end flange 12 and a spaced apart parallel second end flange 14. In an exemplary reel 10, end flanges 12 and 14 are generally circular and may be approximately 60 inches in diameter, and when used in a 6-compartment array, an exemplary reel 10 may be approximately 56 inches in width. Of course, other reel dimensions may be used as well.

End flange 12 may be formed of a tubular circumferential outer ring 20 and a plurality of tubular radially directed spokes 22 which are secured at their outer ends, as by welding, to the ring 20. The ring 20 and spokes 22 may be of a square tubular steel and may be of a nominal one inch dimension. The spokes may be spaced at sixty degree (60°) intervals along the circumference of the ring 20. A central hub 24 comprising a flat steel plate defines an opening 25, such as of a four inch (4") diameter, and secures the inner ends of the spokes 22, as by welding. Desirably, the ring 20 and spokes 22 define a generally co-planar or flat array.

Approximately midway along their lengths, the spokes 22 mount hollow inwardly projecting cylindrical guide posts 26 which may be two inches in length. Posts 26 open into coaxial openings through the spokes. The openings in the posts and spokes may be about 0.375 inch in diameter. A plurality of at least three tie rods 30 having threaded ends 32 are inserted through the guide posts and may be secured with end flange 12 of the reel 10, as by complementary threaded nuts 34. Tie rods are about ⅜" in diameter and may be of carbon steel. In the embodiment illustrated, six tie rods, one at each spoke 22, are used. The number may be varied. As will be understood, the threaded ends of the tie rods extend through the end flange 12, as well as end flange 14, so that the threaded ends may be secured with fasteners, as will be explained.

For protective purposes and to enhance the strength of the end flange 12, a plurality of sheet metal plates 36 may be secured, as by welding, to the outside of the flange 12, such as from locations which are radially outside of the zones of the posts 26 to locations adjacent to the ring 20.

The end flange 14 may be identical to end flange 12 and is adapted to cooperate with the other threaded ends 32 of the tie rods 30 and with additional threaded fasteners 34.

One or more generally circular intermediate partitions may desirably be provided. Each partition ring 40 is oriented generally parallel to the end flanges 12, 14, and comprises a generally circular tubular outer ring 42 and a plurality of radially directed tubular spokes 44, all of which may be steel and of a nominal one inch dimension. Ring 42 is approximately 59 inches in diameter, namely slightly less than the diameter of ring 20 so that it will not contact a floor in use, thereby to reduce the likelihood that the transmission line cable will be damaged during shipment and use of the reel. Spokes 44 are secured, as by welding, to the ring 40 and terminate in a central partition hub 46, in this case comprising a circular support plate which is approximately 2.5 to 3 inches in width. The circular ring 42 and the spokes 44 define a generally co-planar or generally flat array.

The inner ends of the spokes are secured, as by welding, to the partition hub 46, generally centrally of the partition hub width. The partition hub 46 defines projecting portions which project outwardly about ¾" to 1" beyond the spokes 44 at each side of the partition ring 40 to provide supporting projections 47 for the side edges of the cable support cores 50 to be described. The diameter of the partition hub 46 (and projections 47) is such that it just surrounds the tie rods 30.

Support hubs or cores 50 which are located between a partition ring 40 and an end flange 12 or 14, or between adjacent partition rings 40, complete the components of the knock-down cable reel 10. The cores 50 may be about 36 inches in diameter.

A cable reel 10 of the present invention having six compartments C in which cables T may be reeled may be fabricated and assembled in a manner which will now be described.

Figure 4:
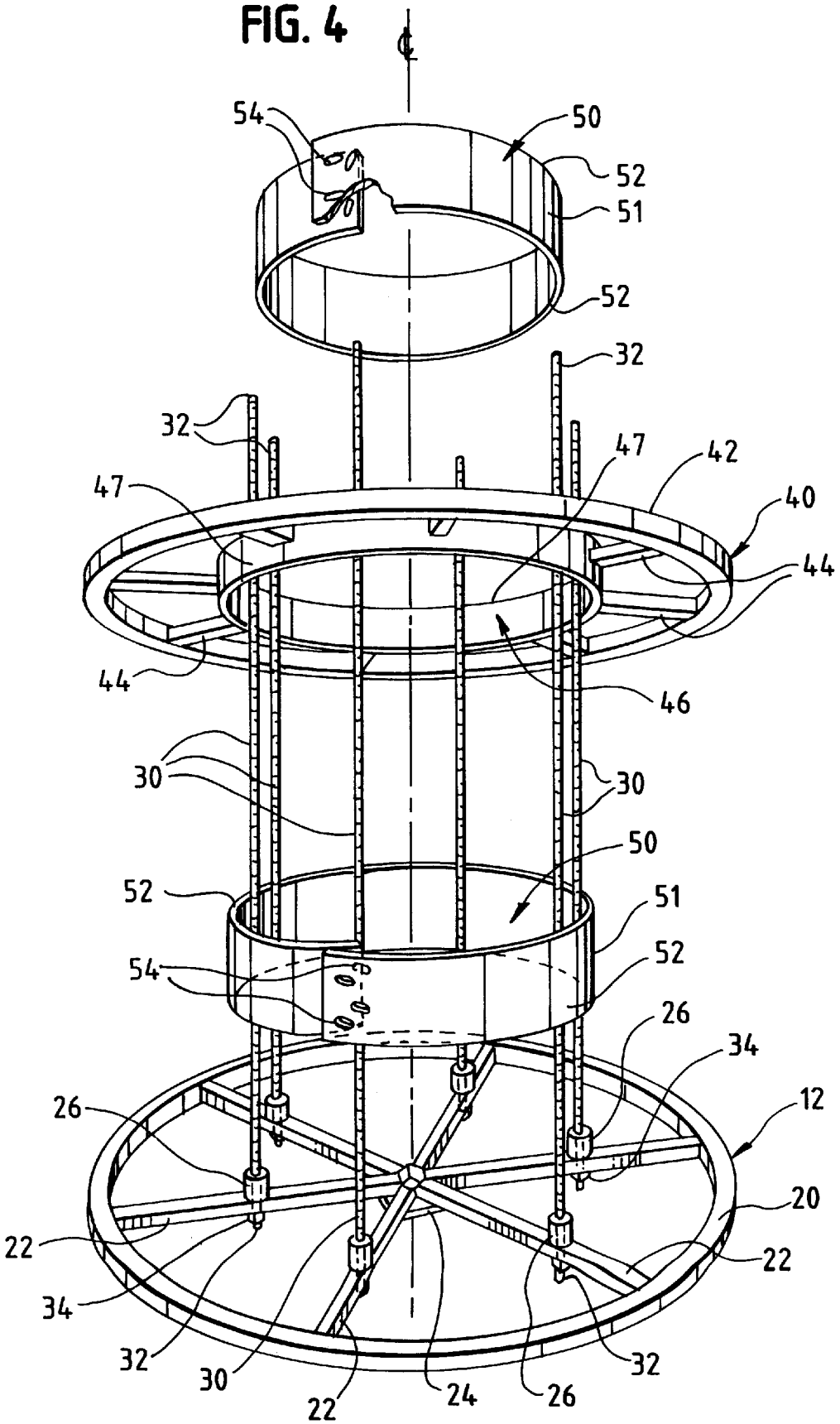
FIG. 4 is an exploded perspective view of the process of assembly of a cable reel of FIG. 1.

First, an end flange 12 constructed as described (having a ring 20, spokes 22, a hub 24 and posts 26) is associated with tie rods, such as six tie rods 30. Threaded fasteners 34 are removably secured to the threaded ends 32 of the tie rods at end flange 12 and the assembly is positioned on a floor with the tie rods 30 projecting upwardly, generally as illustrated in FIG. 4.

Next, a first cable support hub or core such as core 50 is positioned to surround the tie rods 30 and posts 26. Posts 26 help support the adjacent side portions of cable support core 50. Core 50 is an elongated strip of sheet metal, such as spring steel which is formed to close down to a diameter less than that of the partition hub 46 and so that it rolls into a cylindrical configuration. Core 50 may be about 7.5 inches in width and has a central portion 51 and side edges 52. After the core 50 is so positioned against the end flange 12, a partition ring 40 is juxtaposed and positioned so that the support partition hub 46 lies around and surrounds the tie rods 30 and so that partition hub 46 and projection 47 on one side lie within the core 50. At that point, the core 50 lies between the end flange 12 and adjacent partition ring and the side edges 52 of the core 50 bear, respectively, against the spokes 22 of the first end flange 12 and against the spokes 44 of the confronting partition ring 40. This then serves to define the width of the compartment C defined between flange 12 and the adjacent partition ring 40 and to provide the hub or core upon which cable may be coiled in that compartment C. To help rigidify the assembly, the free end portions of the core 50 define slots 54 through which removable fasteners 56, such as sheet metal screws or rivets, may be inserted to lock the complementary end portions together, thereby to provide a secure core.

Thereafter, the next compartment C is constructed by positioning a further core 50 around the tie rods 30 and around the partition hub 46 and against the spokes 44 of the partition ring 40, and by then setting either a second end flange 14 in place to provide a two-compartment array, or by setting a second partition ring in place to build a three to six compartment array.

Assuming the intention is to build an array of three to six compartments, second partition ring 40 is positioned against the second core 50 with the projecting portion 47 of the partition hub 46 thereof internal of the second core 50. That positions the adjacent side edge 52 of the second core 50 against the spokes 44 of the second partition ring 40 with the outer projecting portion 47 of the partition hub 46 serving to provide support and centering for the side edge of core 50. Again, the core 50 serves to define the width of the compartment C between adjacent partition rings 40, and serves to provide a core or hub upon which a cable may be coiled. Again, the core 50 may provide end zone slots 54 through which fasteners 56 may pass to lock the end zones together to provide a secure core.

This series of steps of setting cores 50 and partition rings 40 may be repeated until five compartments have been constructed.

The final compartment in a three to six compartment array is formed by setting a last core 50 around the tie rods 30, against the spokes 44 of the last partition ring 40 and around the partition hub 46 of the last partition ring 40. The second end flange 14, which may be essentially identical to first end flange 12, is then set in place by passing the threaded ends 32 of the tie rods 30 through the cylindrical posts 26 of the second end flange and through the aligned openings in spokes 22 with the last core 50 surrounding the posts 26, and with the side edges 52 of the last core 50 bearing against the spokes 22 of the end flange 14. At this point, the end zones of the core 50 may be secured by disposing fasteners 56 in the slots 54, as has been described.

Finally, threaded fasteners 34 are removably secured to the ends 32 of the tie rods adjacent end flange 14 and are tightened down to releasably secure and bias all the components of reel 10, namely, the end flanges, partition rings, cores and rods, towards each other and together in an assembled array, thereby to provide a solid, rigid multi-compartmented cable reel 10.

The reel 10 is now ready to receive cables T to be wound on the cable support hubs provided by cores 50. Although it is not essential for cable which is of a diameter of ¾" or more, it is desirable, particularly for cable of less than ¾" to provide liners, such as corrugated board liners L at the sides of the compartments C to avoid the tendency of the cable to "belly out" between the spokes into the next adjacent compartment.

It will be apparent that a cable reel 10 will substantially improve and lower the costs of shipping and of installation practices at an RF communications site. Reel 10 permits the shipping of transmission line cables such as coaxial cables of up to six different sizes on one individual metal reel. The reel may be assembled utilizing from one partition to five partitions (from two to six compartments), each compartment containing customer-specified cut lengths of transmission line cable.

When the reel 10 arrives at an RF communications site, a tower crew may position the reel on a pair of jack stands utilizing the openings 25 in the central hubs 24 and then proceed with providing, as necessary, the connectors at the ends of each length of cable. The jack stands are spaced apart and support the reel, as in the back of a pick-up truck, via the openings 25 in the hubs 24. Following this, the tower crew can begin the process of placing hoisting grips on the connector ends of the cables T. The tower crew hoists one cable at a time to its appropriate location on the tower, affixing it to the support structure with hanger kits and then proceeds with the grounding of the cable. After all the lengths of transmission cable are completely installed, the tower crew then removes the cable reel from the jack stands and breaks the reel down for disposal or return to the factory where its components may be reused.

It will be apparent from the foregoing that a modular cable reel can be easily fabricated of standardized components to facilitate the transport of a variety of different cables to a job site, all on a single reel. It is also an important advantage of the present invention that the cable reel 10 is easily knocked down for return and reuse, further minimizing and reducing the expense presently encountered in shipping and handling cable for use in installations where multiple different cable components are necessary. Indeed, the time for setting up the reel 10 at a job site as compared to setting six conventional reels on jack stands is reduced by as much as eighty percent (80%).

It will be appreciated that a cable reel 10 may be quickly disassembled by reversing the assembly process, namely by releasing and removing the threaded fasteners from one end of the reel, and then serially removing an end flange, the cores and the partition rings. The final end flange is then separated from the tie rods. The cores may be opened up by removing the fasteners 56 from the slots 54, as by unscrewing threaded fasteners 56 or by removing any rivet-type fasteners 56 which may have been used. The cores 50 may then be positioned around each other to form a compact array, and then, the end flanges 12, 14 and partition rings 40 may all be stacked, as on a skid, in a knocked-down, compact form and array for return to the factory for reassembly and reuse.

It will be apparent to those skilled in the art that modifications may be made without departing from the spirit and scope of the invention. Accordingly, it is not intended that the invention be limited except as may be necessary in view of the appended claims.

What is claimed is:

1. A knock-down, reusable transmission line cable reel assembly defining at least two side-by-side compartments for coiling transmission line comprising:

a pair of spaced apart, generally circular parallel end flanges, at least one intermediate, generally circular partition ring, each partition ring being oriented generally parallel to said end flanges and being spaced therefrom and from each other, a cable support core comprising a strip having a side edge and a central core portion, said cable support core being positioned between each end flange and adjacent partition ring and between each pair of adjacent partition rings, when more than one partition ring is present, wherein said end flanges define axially inwardly extending projections and wherein said at least one partition ring defines an axially outwardly extending projections, said inwardly and outwardly extending projections being positioned for support of said cable support core by said side edge, a plurality of tie rods extending between said pair of end flanges, extending through said cable support cores, and extending through said partition rings, and releasable fastening means secured to said tie rods for biasing said end flanges towards each other, whereby said releasable fastening means secure said end flanges, partition rings, support cores and tie rods in an assembled array, and so that when said fastening means are released, said end flanges, partition rings, support cores and tie rods are easily separated for transport in a knocked-down form for reassembly and reuse.

2. A knock-down, reusable transmission line cable reel assembly in accordance with claim 1, and wherein said cable support cores comprise elongated core strips having complementary end portions which are secured together by removable fasteners.

3. A knock-down, reusable transmission line cable reel assembly in accordance with claim 2, and wherein each said cable support core comprises an elongated strip of sheet metal which is rolled into a cylindrical configuration.

4. A knock-down, reusable transmission line cable reel assembly in accordance with claim 1, and wherein said tie rods define threaded ends which extend through said end flanges, and wherein said releasable fastening means are threaded fasteners on said threaded ends.

5. A knock-down, reusable transmission line cable reel assembly in accordance with claim 1, and wherein said end flanges each comprises a circular outer ring, a central hub and a plurality of spokes secured to said outer ring and to said central hub.

6. A knock-down, reusable transmission line cable reel assembly in accordance with claim 5, and wherein said spokes mount axially inwardly projecting guide posts for said tie rods and which guide posts form said projections for supporting an adjacent cable support core.

7. A knock-down, reusable transmission line cable reel assembly in accordance with claim 1, and wherein said partition rings each comprises a circular outer ring, a plurality of spokes and a support plate, said spokes being secured to said outer ring and said support plate, said support plate projecting axially outwardly beyond said partition ring spokes for supporting an adjacent cable support core.

8. A knock-down, reusable transmission line cable reel assembly in accordance with claim 1, and wherein said cable reel assembly defines from three to six side-by-side compartments and comprises, respectively, from two to five partition rings and from three to six cable support cores, respectively.

9. A knock-down, reusable transmission line cable reel assembly in accordance with claim 1, and wherein there are at least three tie rods.

10. A knock-down, reusable transmission line cable reel assembly defining at least three side-by-side compartments for coiling transmission line comprising:

a pair of spaced apart, generally circular parallel end flanges having projections extending axially inwardly of the reel assembly therefrom, at least two intermediate, generally circular partition rings, each partition ring being oriented generally parallel to said end flanges and being spaced therefrom and from each other, each partition ring having projections extending axially in a direction outwardly of the reel assembly on each side thereof, a cable support core positioned between each end flange and adjacent partition ring and positioned between each pair of adjacent partition rings, each said cable support core comprising an elongated core strip having side portions and having complementary end portions which are secured together by removable fasteners, said side portions being supported on adjacent projections of said end flanges and said partitions, a plurality of at least three tie rods extending between said pair of end flanges, extending through said cable support cores, and extending through said partition rings, and releasable fastening means secured to said tie rods for biasing said end flanges towards each other, whereby said releasable fastening means secure said end flanges, partition rings, support cores and tie rods in an assembled array, and so that when said fastening means are released, said end flanges, partition rings, support cores and tie rods are easily separated for transport in a knocked-down form for reassembly and reuse.

11. A knock-down, reusable transmission line cable reel assembly in accordance with claim 10, and wherein each said cable support core comprises an elongated strip of sheet metal which is rolled into a cylindrical configuration.

12. A knock-down, reusable transmission line cable reel assembly in accordance with claim 10, and wherein said tie rods define threaded ends which extend through said end flanges, and wherein said releasable fastening means are threaded fasteners on said threaded ends.

13. A knock-down, reusable transmission line cable reel assembly in accordance with claim 10, and wherein said partition rings each comprise a circular outer ring, a plurality of spokes and a support plate, said spokes being secured to said outer ring and said support plate, said support plate projecting axially outwardly beyond the spokes for supporting an adjacent support core.

14. A method of constructing a knock-down, reusable transmission line cable reel assembly comprising the steps of:

providing a first, generally circular end flange, removably securing a plurality of axially extending tie rods to said first end flange, providing and positioning a first cable support core around said tie rods and against said first end flange, providing an intermediate partition ring having a core support means projecting axially outwardly from each side thereof, juxtaposing a first side of said intermediate partition ring with said cable support core lying around said tie rods and with said support means within said first cable support core, positioning a further cable support core around said tie rods, around said support means and against a second side of said intermediate partition ring, positioning a second end flange against said further cable support core, and removably securing said tie rods to said second end flange and biasing said end flanges towards each other to releasably secure said end flanges, partition rings, support cores and tie rods against each other thereby to provide a cable reel assembly having at least two side-by-side cable compartments, and wherein said end flanges, partition rings, support cores and tie rods may be readily separated for transport in a knocked-down form for reassembly and reuse.

15. The method of claim 14 and wherein said tie rods have threaded ends and wherein the steps of removably securing said tie rods and biasing the end flanges towards each other comprises securing threaded fasteners to said threaded ends and tightening said fasteners against said end flanges.

16. The method of claim 14, and wherein after positioning said further cable support core, the method comprises the further step of providing a further intermediate partition ring having a core support means and juxtaposing said further intermediate partition ring support means on one side within said further support core, then positioning another cable support core around the tie rods, around the support means of said further intermediate partition ring and against said further intermediate partition ring, all prior to positioning said second end flange, thereby to provide a cable reel assembly having at least three side-by-side cable compartments.

17. The method of claim 14, and wherein said step of providing and positioning a cable support core comprises forming an elongated metal strip having a central support portion, axial side edge portions and complementary end portions and securing said end portions to each other with removable fasteners.

18. The method of claim 17, and wherein said elongated metal strips are a resilient spring steel strips formed in cylindrical configurations.

* * * * *

UNITED STATES PATENT AND TRADEMARK OFFICE

CERTIFICATE OF CORRECTION

PATENT NO. : 5,934,606
DATED : August 10, 1999
INVENTOR(S) : Joseph R. Guild

It is certified that error appears in the above-identified patent and that said Letters Patent is hereby corrected as shown below:

Column 6, line 42, delete "an";

Signed and Sealed this

Twenty-first Day of March, 2000

*Attest:*

*Attesting Officer*

Q. TODD DICKINSON

*Commissioner of Patents and Trademarks*